US005140355A

United States Patent [19]

Haag et al.

[11] Patent Number: 5,140,355

[45] Date of Patent: Aug. 18, 1992

[54] CONTINUOUS DEVELOPING APPARATUS

[75] Inventors: Siegfried Haag, Korntal; Joachim Korn, Bietigheim-Bissingen, both of Fed. Rep. of Germany

[73] Assignee: Durr Dental GmbH & Co KG, Fed. Rep. of Germany

[21] Appl. No.: 458,708

[22] PCT Filed: Dec. 3, 1988

[86] PCT No.: PCT/EP88/01104

§ 371 Date: Jan. 30, 1990

§ 102(e) Date: Jan. 30, 1990

[87] PCT Pub. No.: WO89/05479

PCT Pub. Date: Jun. 15, 1989

[30] Foreign Application Priority Data

Dec. 7, 1987 [DE] Fed. Rep. of Germany ..... 3741376

[51] Int. Cl.[5] ..... G03D 13/00; G03D 3/08

[52] U.S. Cl. ..... 354/299; 354/319; 354/323; 354/324

[58] Field of Search ..... 354/319, 249, 320, 321, 354/323, 324

[56] References Cited

U.S. PATENT DOCUMENTS 4,023,190 5/1977 Fassler ..... 354/319
4,577,949 3/1986 Geyken ..... 354/319

FOREIGN PATENT DOCUMENTS 0239751 10/1987 European Pat. Off. .
1495745 12/1977 United Kingdom .

*Primary Examiner*—L. T. Hix
*Assistant Examiner*—D. Rutledge
*Attorney, Agent, or Firm*—Fred Philpitt

[57] ABSTRACT

An automatic continuous developing apparatus has processing chambers dynamically sealed by a pair of rollers. Flood tanks are located between the processing chambers and the outer tanks surrounding the latter. In a raised position the flood tanks maintain a liquid level above the conveyor rollers in the processing chambers, while in a lowered operating position they free the inlet and outlet opening of the processing chambers.

34 Claims, 9 Drawing Sheets

CONTINUOUS DEVELOPING APPARATUS

The invention relates to a continuous developing apparatus for photographic films, in particular X-ray films.

BACKGROUND

An apparatus of this type is described in U.S. Pat. No. 4,023,190. In the latter, the papers and pieces of film to be developed are moved with only a quite slight deviation from a continuous conveying plane and due to the dynamic sealing of the processing chambers, at their inlet or outlet opening, a liquid level lying above the conveying plane can be maintained dynamically in the processing chamber, since the circulating pump associated with the processing chamber can supply slightly more processing liquid to the dynamically sealed processing chamber than is lost through the leakage points at the inlet opening and outlet opening.

However, if a developing apparatus of this type is stopped for a relatively long time, for example overnight or for the weekend, or if the apparatus is generally only required at intervals of several days, then when the circulating pump is switched off, on account of the leakage losses at the dynamic seals, the liquid level falls slowly to below the seals. Thus, the conveying means serving for moving the material to be developed are at least partially no longer covered with processing liquid and after the evaporation of water, developer salt or fixer salt remains on the conveying means. After the apparatus is once more set in operation, these salt crusts dissolve only slowly or on the whole no longer completely and then impede the troublefree conveyance and uniform processing of the material to be developed and may lead to scratches on the film.

Further developing apparatus with dynamically sealed processing chambers, filled with liquid, are described for example in U.S. Pat. No. 3,057,282, DE-OS 26 33 145, DE-OS 27 31 045 and DE-PS 33 45 084. For these developing apparatus, the above-described drawbacks are true to the same extent.

THE INVENTION GENERALLY

The present invention intends to develop a developing apparatus so that even with a relatively long stoppage of the apparatus, no salt crusts are formed on the conveying means, which serve for moving the material to be developed through the processing chambers.

This object is achieved according to the invention by a developing apparatus according to the following description.

In the developing apparatus according to the invention, a flood tank is additionally located below at least one processing chamber. In an operating position preset in the operating apparatus, the latter frees the inlet opening and the outlet opening of the associated processing chamber, so that in this case the same operating conditions exist as in the known developing apparatus described at the beginning, with the single difference that processing liquid overflowing from the processing chamber does not trickle back directly into the outer tank, on the contrary first of all passes into the flood tank and then overflows from the latter into the outer tank. However, as regards the liquid processing of the material to be developed, this difference is negligible.

In a raised operating position, which the flood tank assumes when the developing apparatus is switched off, the overflow edge of the flood tank lies above all the conveying means of the associated processing chamber. The conveying means are thus completely immersed in processing liquid, and thus no salt crusts may form thereon, even in the case of a very long stoppage of the developing apparatus. Since the flood tank is normally filled with processing liquid at the beginning of the lifting operation and at the time of lifting the flood tank, part of this liquid is displaced by the conveying means and the other parts of the processing chamber, reaching a sufficiently high liquid level is always guaranteed, even if the circulating pump is stopped at the beginning of the lifting operation.

Vertically movable outer tanks are already known per se in continuous developing apparatus. Thus, U.S. Pat. No. 3,624,728 discloses an automatic developing apparatus with a vertically movable tank arrangement. It is thus ensured that the chemicals can be easily replaced, without having to make any intervention with the conveying mechanism. U.S. Pat. No. 3,587,429 discloses a developing apparatus, which has a deformable tank base. Due to the deformation of this base, the processing liquid can be raised optionally to the conveying path of the material to be developed. U.S. Pat. No. 3,093,051 describes a liquid application station, in which trays containing two different processing liquids can be moved optionally into the conveying path of the material to be processed, for which a parallelogram linkage in conjunction with a crank drive is used.

In the apparatus described in the printed specifications mentioned last, the movement of a tank is used for the purpose of bringing a processing liquid optionally to the conveying plane of the material to be processed. It is not attempted to immerse conveying devices of a dynamically sealed processing chamber completely in a volume of processing liquid, when the developing apparatus is stationary. Also, in these known apparatus, the tank itself is moved, whereas in the apparatus according to the invention, the outer tank is just as stationary as in the initially described, known developing apparatus according to U.S. Pat. No. 4,023,190. In the developing apparatus according to the invention, a flood tank provided by way of addition is raised and lowered, which is not encountered in any of the previously evaluated, known apparatus.

With the development of the invention according to another embodiment it is ensured that the streams of liquid displaced from the flood tanks, as they are raised, do not overflow in an uncontrolled manner over the entire upper edges of the boundary walls of the tanks, on the contrary, at the point predetermined by the overflow recess, a larger liquid stream which is defined in a geometrically exact manner is obtained. Thus the danger that drops of liquid enter an adjacent outer tank (for example the dripping of fixing liquid into the developer outer tank) is considerably reduced.

Also the development of the invention according to another embodiment serves for a controlled, splash-free return of the liquid overflowing from the flood tank into the outer tank located respectively therebelow.

In a developing apparatus according to another embodiment the stream of liquid overflowing from the flood tanks flows back into the outer tank in each case without striking the free surface of the liquid located in the associated outer tank.

With the development of the invention according to another embodiment, it is ensured that the streams of liquid overflowing from the flood tanks run back into the outer tank located therebelow at points remote from the adjacent outer tanks for other processing liquids.

In a developing apparatus according to another embodiment, it is ensured that the drive device associated with the conveying means, in so far that it is not completely immersed in the processing liquid (these parts of the driving device are made from correspondingly corrosion-proof material), is protected from splashes of liquid.

In a developing apparatus according to another embodiment when they are dismantled from the apparatus, one can place the flood tanks reliably on a flat surface, although they are provided with a drip bar solely on one of their sides.

In a developing apparatus according to another embodiment a plurality of flood tanks following each other in the conveying direction can be raised and lowered by a common lifting device, which reduces both the mechanical expenditure as well as the expenditure for circuitry.

In a developing apparatus according to another embodiment one can raise an intermediate wall separating successive outer tanks, particularly far, which is an advantage with regard to good screening of these outer tanks with respect to each other.

With the development of the invention according to another embodiment, it is ensured that the drive motor of the lifting device needs to apply solely a low residual force. This drive thus does not need to be designed for high power; furthermore it can bring about the movement of the flood tanks between their two positions quickly, so that the operative state of the apparatus is achieved particularly quickly. Since the total weight of the flood tank and processing liquid located therein decreases at the time of lifting due to the overflow of displaced processing liquid, but also the force of the spring arrangement decreases with the lifting displacement, as a whole a residual force approximately independent of the distance covered can be achieved.

With the development of the invention according to another embodiment, it is ensured that even in the case of processing chambers with a large dimension transversely with respect to the conveying direction of the material to be developed, the flood tanks can be raised and lowered without the danger of tipping or jamming, reliably and with low force.

The development of the invention according to another embodiment is an advantage with regard to compact and simple geometry of the sub-unit formed by the lifting rods and the spring arrangement.

In a developing apparatus according to another embodiment the helical springs and the lifting rods do not need to be made from a corrosion-resistant material. Furthermore, the guide device for the lifting rods does not need to undertake a sealing function at the same time, so that this guide device can be designed for particularly good ease of motion, for example the lifting rods can be given cross-shaped cross-sectional geometry.

In a developing apparatus according to another embodiment, the flood tanks can be removed quickly and simply from the outer tanks, for example when liquid still located therein has to be removed for the complete exchange of the processing liquids.

With the development of the invention according to another embodiment, it is ensured that the processing liquids can be introduced into the processing chambers with a uniform distribution and indeed at such a point that they flow through the entire processing chamber.

With the development of the invention according to another embodiment it is ensured that the supply part supplying the processing liquid has small dimensions, furthermore, the sealing point at the inlet end of the supply part lies close to that region of the apparatus which is constructed in particular for the return of processing liquid, so that at this point, no very great demands must be made of the seal.

With the development of the invention according to another embodiment it is ensured that the connection between the supply part and the delivery opening for the treatment liquid integral with the housing can be made automatically with the vertical insertion and can be broken with the vertical removal of the flood tanks.

With the development of the invention according to another embodiment it is ensured that the projecting section of the supply part has a short construction in the vertical direction, thus is exposed to only slight bending stresses when pressed against the delivery opening integral with the housing.

The development of the invention according to another embodiment is an advantage with regard to a controlled, immediate return of leakage liquid emerging at the sealing point between the supply part and delivery opening integral with the housing, into the associated outer tank of the apparatus.

The development of the invention according to another embodiment serves for the uniformity of delivery of fresh treatment liquid to the inside of the processing chamber in question.

The development of the invention according to another embodiment is an advantage with regard to a simple manufacture of the entire lower region of a processing chamber not sealed by conveying rollers, likewise with regard to simple mounting and exchange of this region and with regard to simple cleaning of this region and mutual accessibility of the conveying rollers for periodic, basic cleaning.

With the development of the invention according to another embodiment it is ensured that the base part and the sealing lips supported thereby can be fitted to the processing chamber solely so that the sealing lips bear positively with the desired geometry and under the desired reference bending pre-tension against the lower rollers of the pair of rollers defining the inlet opening or outlet opening.

The development of the invention according to another embodiment is an advantage with regard to a particularly simple and reliable insertion of the base part, with exact presetting of the insertion distance.

The development of the invention according to another embodiment serves for the simple production of the base part and sealing lips in a single injection moulding operation.

With compact overall dimensions, a lifting device, as defined in another embodiment, produces a large lift of the flood tanks. Also, the upper and lower end position of the flood tanks is well maintained on account of the crank characteristic, even if the driving motor of the lifting device is controlled by end position sensors which do not respond very exactly.

In a lifting device according to another embodiment, the entire power transmission between the driving motor and flood tanks is independent of the lifting distance covered.

The same advantage is achieved in a lifting device according to another embodiment.

With the development of the invention according to another embodiment, it is ensured that when introducing material to be developed into the develop apparatus, the flood tanks are automatically lowered, if they were previously in their raised flooding position. Furthermore, after the termination of a developing operation, the flood tanks are automatically raised from the lower operating position back into the flooding position flooding the entire conveying means.

In a developing apparatus according to another embodiment the feeding region receives material to be developed even when the conveying path is still blocked by a raised flood tank at a point located further back in the apparatus. The user thus does not need to wait until the apparatus is completely ready for operation and can turn immediately to another activity. Also he does not gain the impression that the apparatus is not ready for operation.

With the development of the invention according to another embodiment, it is ensured that in the processing chambers, the liquid level lying above the conveying path is maintained positively in a dynamic manner, when the flood tanks are lowered. Furthermore, a circulation of liquid always takes place when a temperature sensor ascertains that the liquid must be heated. Thus, overheating of the processing liquids in the associated heating devices is precluded.

With the development of the invention according to claim 32, it is ensured that the circulation of the processing liquids through the associated heating devices is maintained for a predetermined period of time after the latter are switched off.

In a developing apparatus according to another embodiment one can empty the residual quantities of processing liquid located in the flood tanks into the associated outer tank, so that for the complete renewal of the processing liquids, the flood tanks do not need to be removed from the apparatus.

The development of the invention is an advantage with regard to particularly simple actuation of the discharge valves of the flood tanks, in particular a servo-actuation using the drive of the lifting device.

DRAWINGS

The invention will be described in detail by means of embodiments, referring to the drawings, in which.

DETAILED DESCRIPTION OF THE INVENTION

Figure 1:
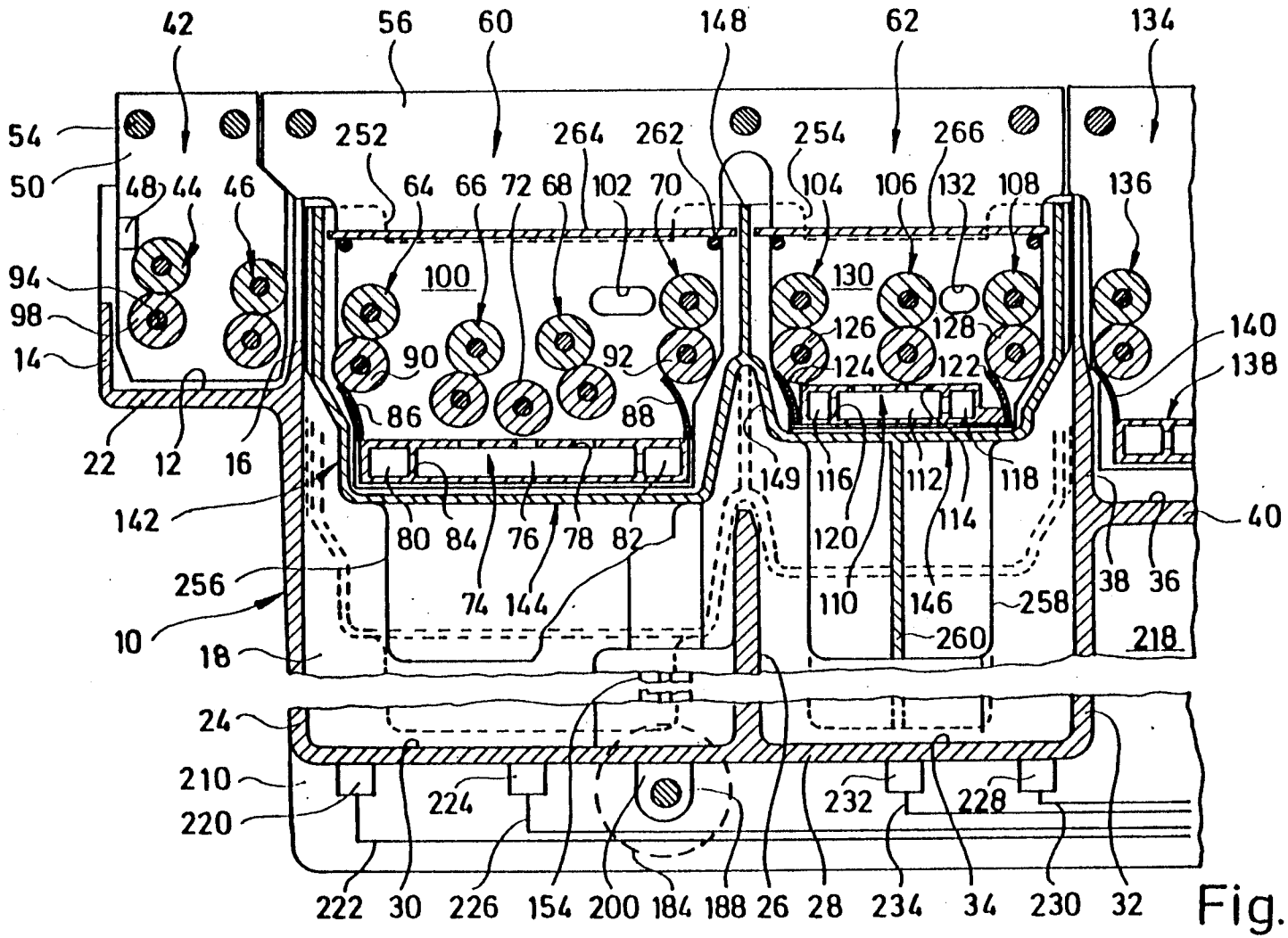
FIG. 1 is a vertical longitudinal section through the insertion region, the developer region, the fixer region and the first section of the washing region of a continuous developing apparatus for X-ray films.

In FIG. 1, a housing for a continuous developing apparatus is designated generally by the reference numeral 10. The latter defines an inlet chamber 12, which is defined by a front end wall 14 and a rear, first intermediate wall 16 as well as the left-hand side wall 18 and the right-hand side wall 20 and a projecting wall 22. Here, as later, the terms "front", "rear", "left-hand" and "right-hand" relate to the conveying direction of the material to be developed travelling through the developing apparatus, thus to an observer's standpoint at the inlet end of the developing apparatus.

A developing tank chamber 30 is defined by a front end wall 24, a second intermediate wall 26 and the side walls 18 and 20 as well as a bottom wall 28 of the housing 10. Similarly, together with a rear end wall 32 of the housing 10 and its side walls 18 and 20 as well as the bottom wall 28, the second intermediate wall 26 defines a fixing tank chamber 34.

A washing tank chamber 36 is defined by a third intermediate wall 38, a fourth intermediate wall located downstream thereof and not shown in the drawings, the sides walls 18 and 20 and a raised bottom wall 40 of the housing 10.

Located in the inlet chamber 12 is a feed rack designated generally by the reference numeral 42 with pairs of feed rollers 44, 46. A light barrier 48 operating by reflection then produces an output signal, when film material to be developed is located directly below it, thus shortly in front of the feed gap of the apparatus defined by the pair of rollers 44.

The pairs of rollers 44, 46 are mounted in side plates 50, 52, which are securely connected to each other by rods 54.

In a similar manner, two side plates 56, 58, which are likewise connected by rods 54, form the support structure for a double rack able to be handled in one piece, whereof the section associated with the developing region is designated generally by the reference numeral 60 in the drawing and whereof the section associated with the fixing region is designated in particular by the reference numerals 62.

Belonging to the developing rack 60 are four pairs of rollers 64 to 70 arranged substantially symmetrically to the transverse central plane of the rack, which in the developing region define a curved conveying path section for the material to be developed. Located between the pairs of rollers 66 and 68 is a single guide roller 72, which guides the material to be developed at the lowest point of the conveying path to the pair of rollers 68.

A base part 74 is releasably located using a bayonet connection at the lower ends of the side plates 56, 58, in the developing region, which base part will be described in more detail hereafter with reference to FIG. 4. The base part 74 is a hollow injection moulded part with a central distribution chamber 76, which is connected by way of a plurality of uniformly distributed openings 78 to the inside of the developing rack 60. At the sides of the distribution chamber 76, extending at right angles to the plane of the drawing of FIG. 1 are two supply channels 80, 82 for the developing liquid, which are connected by way of openings 84 to the distribution chamber 76. Details of the supply of the developing liquid to the supply channels 80, 82 will likewise be given hereafter, with references to FIGS. 3 and 4.

Sealing lips 86, 88 extending at right angles to the plane of the drawing of FIG. 1 are injection-moulded at the front and rear end of the base part 74. These sealing lips consist of an elastically yielding, soft synthetic material and are injection-moulded directly onto the base part 74. When they are not under load, the sealing lips 86, 88 stand up vertically on the surface of the base part 74. When the base part 74 is inserted correctly, the sealing lips 86, 88 bear in the manner shown in FIG. 1, with bending-pre-tension against the outer surface of the lower roller 90 of the pair of rollers 64 or against the lower roller 92 of the pair of rollers 70. These rollers, which rotate in clockwise direction with the given conveying direction of the material to be developed (in FIG. 1 from left to right), thus come into contact with the sealing lips 86, 88 bearing resiliently thereon.

Like the remaining rollers of the developing apparatus, the pairs of rollers 64 and 70 consist of a hard core 94 and a resiliently yielding overlay 98. Furthermore, the centre distance of the rollers of a pair of rollers is chosen so that the peripheral surfaces of these rollers bear tightly one against the other. The front and rear end faces of the overlays 98 are guided directly up to the side plates 56, 58 and rotate with sliding friction thereon. For this purpose, a washer of a low friction material can be inserted between the end of the overlay 98 and the adjacent side plate.

Together with the sealing lips 86, 88 and the base part 74 supporting the latter, the pairs of rollers 64 and 70 thus form a substantially liquid-tight developing chamber 100. Only small leakage streams of liquid escape through the dynamic sealing points formed by the pairs of rollers 64, 70 and the sealing points between the sealing lips 86, 88 and the rollers 90 and 92, which streams are negligible compared with the stream of developing liquid supplied to the supply channels 80, 82.

In order that the developing liquid supplied continuously by circulating pumps when the device is stationary, does not flow over the upper rollers of the pairs of rollers 64, 70 located at the ends of the developing chamber 100, an overflow opening 102 is provided in the side plate 56, the lower edge of which opening determines the working level of the developing liquid. This level clearly lies above the inlet opening of the developing chamber 100 defined by the pair of rollers 64, above the outlet opening of the developing chamber 100 defined by the pair of rollers 70 and above all the regions of the conveying path for the material to be developed located therebetween. Both surfaces of the material to be developed are thus satisfactorily in contact with developing liquid.

The fixing rack 62 has a quite similar construction to that of the developing rack 60 just described in detail. Pairs of rollers 104, 106, 108 define a straight conveying path in the developing region. A base part 110 connected by way of a bayonet connection to the side plates 56, 58 has a central distribution chamber 112, which is connected by way of openings 114 to the interior of the fixing rack 62, as well as lateral supply channels 116, 118, which are connected by way of openings 120 to the distribution chamber 112. Elastically yielding sealing lips 122, 124 are again injection-moulded on the ends of the base part 110, which sealing lips co-operate with the lower roller 126 of the pair of rollers 104 or the lower roller 128 of the pair of rollers 108. Together with the sealing lips 122 and 124 on the base part 110, the pairs of rollers 104 and 108 again form a substantially liquid-tight processing chamber, namely the developing chamber 130. An overflow opening 132 in the side plate 56 again determines the working level of the developing liquid, so that the developing liquid washes around the material to be developed on both sides over its entire path through the developing chamber 130.

Inserted in the washing tank chamber 36 is a washing rack 134 designated generally by the reference numeral 134. In the latter, a pair of rollers 136 at the inlet side, a pair of rollers at the outlet side (not shown in FIG. 1) a base part 138 and sealing lips injection-moulded on the latter, of which in FIG. 1, only the sealing lip at the inlet side is shown at 140, form a substantially liquid-tight processing chamber, from which the water supplied by way of the base part 138 is once more drawn off through an overflow opening, which is not shown in FIG. 1, but is arranged in an equivalent manner to the overflow openings 102 and 132. Located below the developing rack 60 and the fixing rack 62 is a double flood tank 142. The latter consists of a developing flood tank 144 and a fixing flood tank 146, which are held together by way of a common intermediate wall 148. The cross-sectional contour of the two flood tanks 144 and 146 is chosen so that the various wall sections of the flood tanks surround the developing rack 60 or the fixing rack 62 at a short distance, when the double flood tank 142 is located in a raised flooding position, which is shown in full line in FIG. 1.

In the region of the intermediate wall 148, the base of the double flood tank 142 is provided with a recess 149, in which the intermediate wall 26 may engage, when the double flood tank 142 is lowered from its roller-flooding position shown in full line in FIG. 1, into an operating position shown in broken line in FIG. 1. In the latter, the front and rear end wall of the double flood tank 142 lie below the path of the material to be developed determined by the conveying rollers and thus free the latter. In the flooding position, the tank end walls block this path and in the developing rack 60 or in the fixing rack 62, irrespective of the fact that the developing chamber 100 and fixing chamber 130 are only sealed dynamically, thus leak somewhat, maintain such a high liquid level that the rollers of this rack are completely immersed in the processing liquids. Thus, no solid residues may form on these rollers, such as may otherwise occur due to the evaporation of the water from droplets of processing liquid remaining on the rollers, when the device is switched off.

Figure 2:
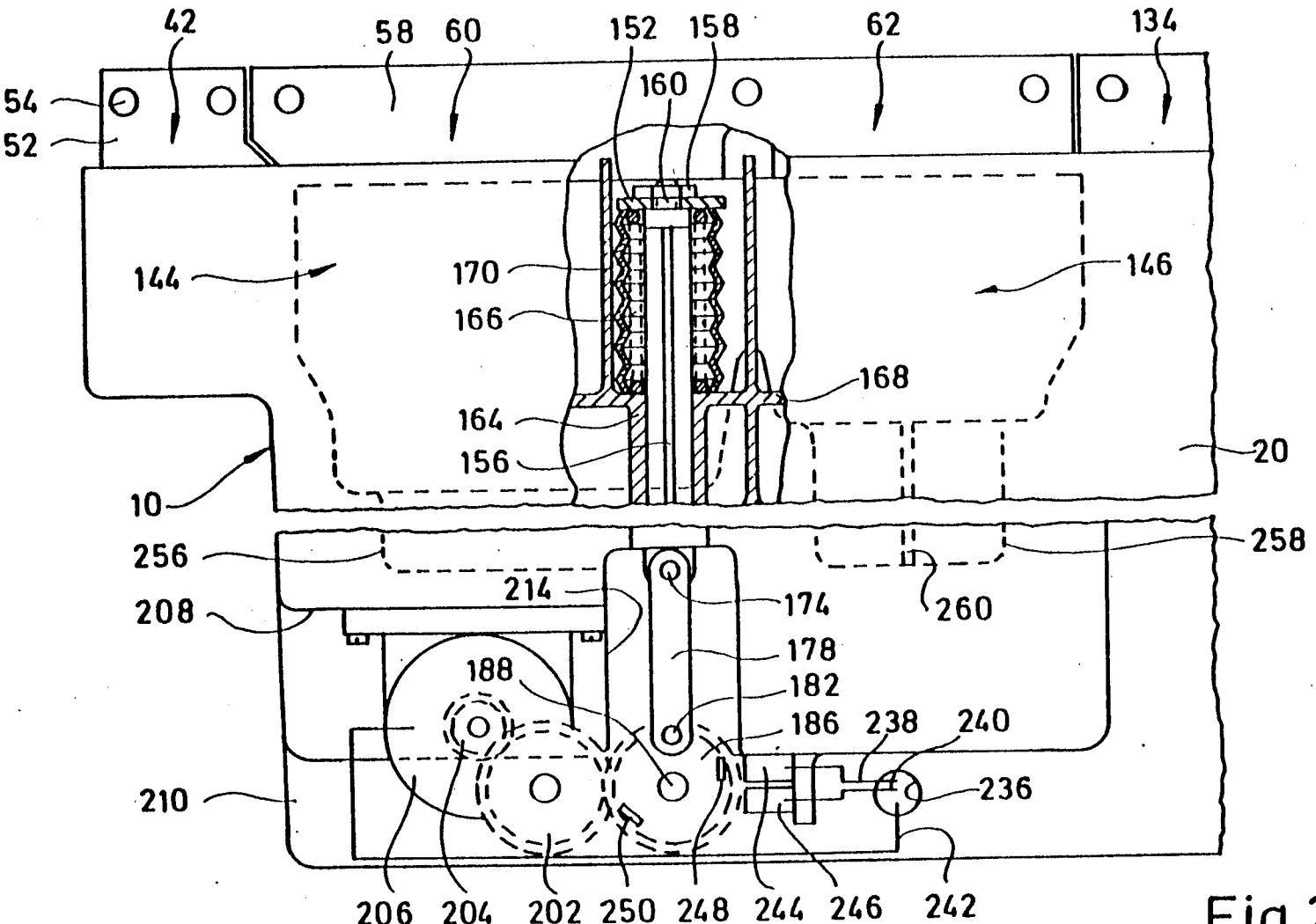
FIG. 2 is a plan view of the side wall of the developing apparatus according to FIG. 1, located above the plane of the drawing of FIG. 1, in which some parts of the tank housing are cut away, in order to show details of a lifting device for a double flood tank.
Figure 3:
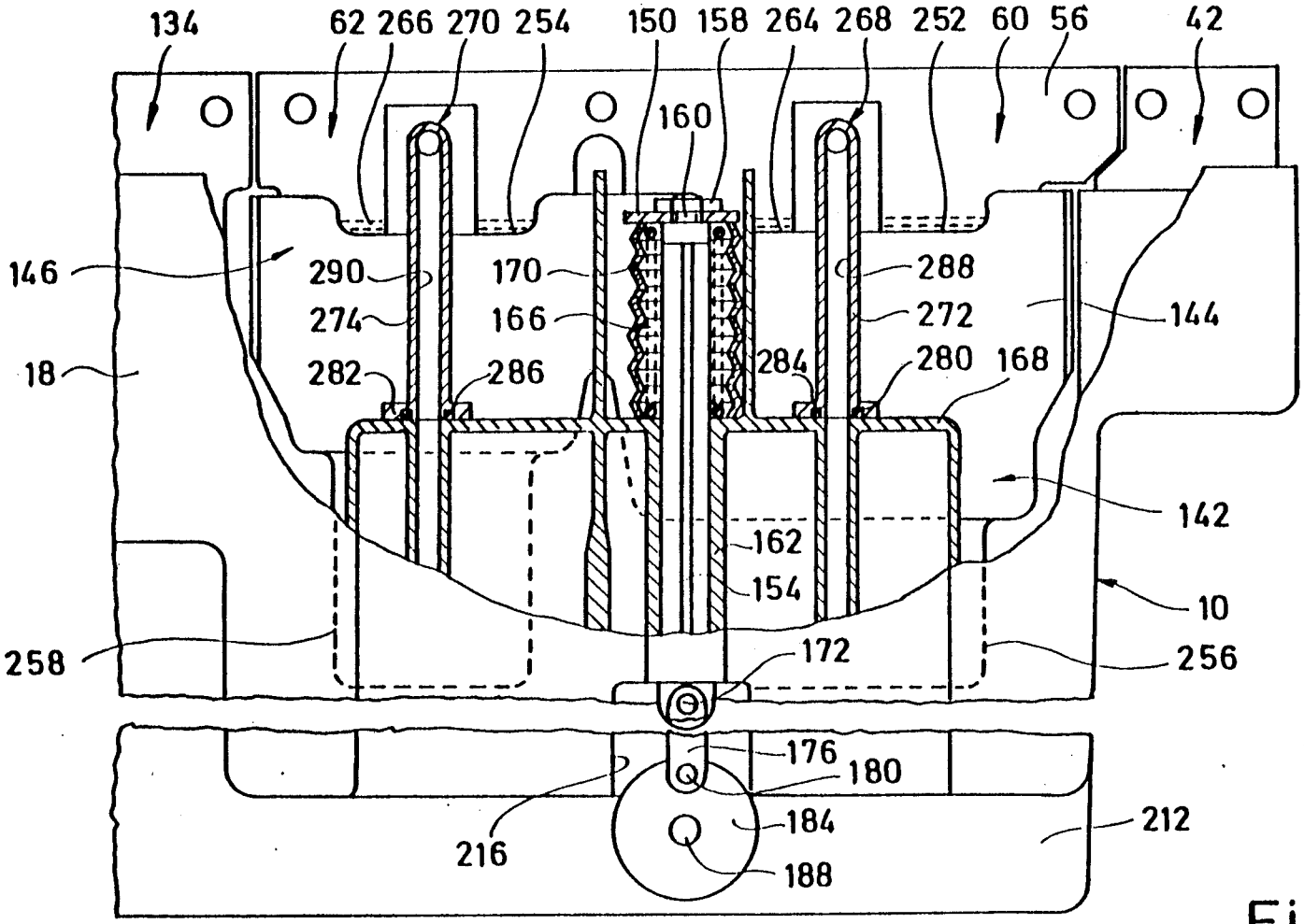
FIG. 3 is a plan view of the side wall of the developing apparatus according to FIG. 1, located behind the plane of the drawing of FIG. 1, some parts of the tank housing being cut away in order to show details of the lifting device for the double flood tank and of the supply of the processing liquids into the developer processing chamber and the fixer processing chamber.

As can be seen best in FIGS. 2 and 3, the double flood tank 142 has lateral support arms 150, 152, by which it is attached to the upper ends of two lifting rods 154, 156, for example by using a nut 158, which is screwed onto an end section 160 of the lifting rod in question, which is provided with a screw thread and guided through the support arm in question.

The lifting rods 154, 156 have a cross-shaped transverse cross-section and run in guide bushes 162, 164, which are formed in the housing 10.

The upper ends of the lifting rods 154, 156 are surrounded by helical springs 166, whereof the lower end is supported on a horizontal intermediate wall 168 of the housing 10 and whereof the upper end engages on the under side of the support arms 150, 152.

The helical springs 166 are in turn surrounded by bellows 170, whereof the upper end is connected in a tight manner to the associated support arm 150 or 152 and whereof the lower end is connected in a tight manner to the horizontal intermediate wall 168.

The lower ends of the connecting rods 154, 156 are connected by way of connecting pins 172, 174 to the driving end of a connecting rod 176, 178. The driven end of the latter is pivotally seated on a crank pin 180, 182, which is supported by a crank disc 184, 186.

The two crank discs 184, 186 are rotationally connected by a shaft 188, which rotates in bearing lugs 200 formed on the bottom wall 28.

As can be seen from FIG. 2, the crank disc 186 is provided with a gear rim and meshes with a freewheeling gear 202, on which the pinion 204 of a synchronous motor 206 acts.

The synchronous motor 206 is screwed securely to a housing shoulder 208 which is set back and formed on the bottom wall 28, on its lateral edges, are two support ribs 210, 212, which on the one hand facilitate unhindered rotation of the crank discs 184, 186, on the other hand facilitate the laying of hoses and cables on the under side of the device. Retracted regions 214, 216 of the side walls 18, 20 of the housing 10 receive an upper section of the crank discs 184, 186 and allow the lateral swinging-out of the connecting rods 176 and 178. As can also be seen from FIG. 1, a larger compartment 218 remains below the washing chamber 36, in which pumps for circulating the various processing liquids, for the metered subsequent supply of chemicals as well as heating devices for the processing liquids can be located. FIG. 1 also shows four hoses between the support ribs 210, 212, namely a developer return hose 222 connected to a developer discharge connection 220, a developer supply hose 226 connected to a developer supply connection 224 of the housing 10, a fixer return hose 230 connected to a fixer discharge connection 228 as well as a fixer supply hose 234 connected to a fixer supply connection 232 of the housing 10.

As also shown in FIG. 2, by way of an opening 236 in the support rib 210, cables 238, 240, 242 are guided into the hose and cable passage defined by the support ribs 210, 212, which cables are connected to light barriers 244, 246 operating by reflection or to the synchronous motor 206.

The light barrier 244 represents a sensor for the upper end position of the double flood tank 142. Located opposite the latter, when the double flooding tank is fully raised, is a mirror 248 supported by the crank disc 186.

The light barrier 246 is a sensor for the lower end position of the double flood tank 142 and co-operates with a second mirror 250 supported by the crank disc 186, which mirror is located opposite the light barrier 246 when the crank pins 180, 182 have reached their bottom dead centre. Together with the light barrier 48, the light barriers 244, 246 serve for controlling the raising and lowering of the double flood tank 142, as will be described in even more detail hereafter with reference to FIG. 8.

At the upper end of their side walls located at the rear in FIG. 1, the flood tanks 144 and 146 are provided with an overflow recess 252, 254. Processing liquid displaced from inside the flooding tanks thus flows solely at an exactly defined point in the vicinity of the centre of the developing region or of the fixing region from the flood tanks. Aligning in the vertical direction with the overflow recesses 252, 254, the flood tanks 144 and 146 are provided with drip bars, 256, 258 hanging downwards. The height thereof is measured so that the lower end of the drip bars 256 and 258 is still immersed in the liquid even at the lowest, still admissible liquid level in the developer tank chamber 30 or fixer tank chamber 34. In this way, processing liquid displaced from inside the flood tanks passes without splashing in a laminar, well-defined liquid stream into the tank chamber located therebelow.

After being dismantled from the lifting rods 154, 156, in order that the double flood tank 142 can be placed safely on a flat surface, a transverse support rib 260 is formed on the base of the flood tank 146, the height of which rib corresponds to the height of the drip bar 258.

Since the developer flood tank 144 has the drip bar 256 solely on one side, but is free from such a bar on the other side, at this point one can also use the housing 10 for locating the synchronous motor 206.

The side plates 56, 58 carry four support pins 262, on which a cover 264 or a cover 266 lie. These covers engage with little clearance between the side plates 56, 58 and the transverse walls of the flood tanks 144, 146. The position of the support pins 262 is chosen so that the under side of the cover 264, 266 aligns with the lower edge of the overflow recesses 252, 254 defining the height of the liquid level in the flooding position. When the developing device is switched off, the volume of liquid located in the flood tanks 144, 146 is thus largely protected against the admission of oxygen from the air.

Figure 4:
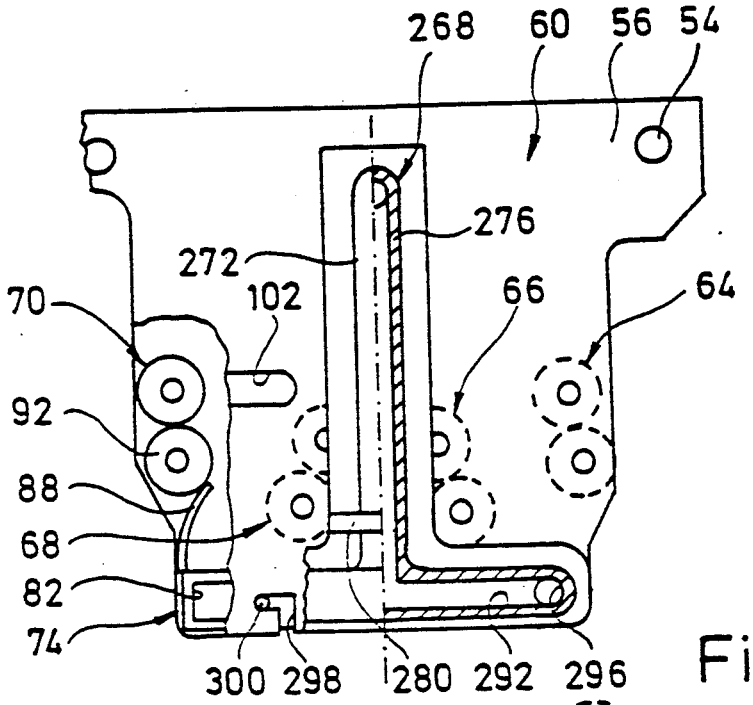
FIG. 4 is a plan view of the front end of the part of a double processing chamber associated with the developer region, which is sealed dynamically by rollers and sealing lips, a supply part for developing liquid being shown partly in section and a part of the side plate of the processing chamber located at the front in FIG. 4, being cut away.

As can be seen from FIGS. 3 and 4, the supply of developing and fixing liquid to the base parts 74 and 110 takes place using supply parts 268, 270 fitted to the outer side of the side plate 56. The latter have an inlet section 272, 274 lying at the front in FIGS. 3 and 4 and extending vertically downwards, as wall as a delivery section 276 directly adjacent to the side plate 56 and likewise extending downwards. These two sections are connected by way of an intermediate section to form a supply channel, which is in the shape of an inverted U.

The lower end of the inlet sections 272, 274 is provided with a flange 280, 282, which with the use of a sealing ring 284, 286 is fitted tightly to the upper side of the horizontal intermediate wall 168. Opening into the latter, opposite the inlet section 272, is a developer supply channel 288 connected to the developer supply connection 224. The inlet section 274 of the supply part 270 communicates with a fixer supply channel 290, which comes from the fixer supply connection 232.

As shown in FIG. 4, the lower end of the delivery section 276 of the supply part 268 is connected to two branch channels 292 extending in the longitudinal direction of the side plate 56, whereof the ends are connected by way of openings 296 in the side plate 56 to the supply channels 80, 82 of the base part 74.

As can also be seen from FIG. 4, bayonet grooves 298 are provided in the lower end of the side plate 56 and similarly in the lower end of the side plate 58, in which grooves bayonet pins 300 supported by the end walls of the base part 74 engage.

In the case of the fixing rack 62, the supply of liquid and the attachment of the base part take place in a similar manner to the developing rack 60.

Figure 5:
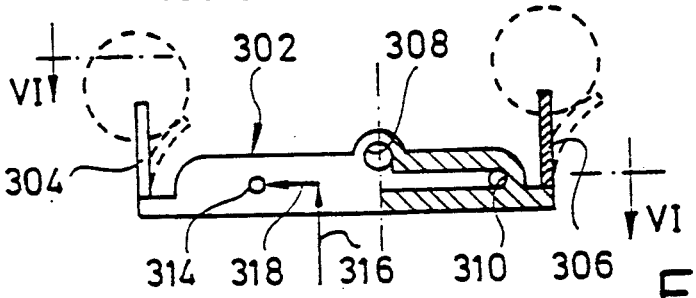
FIG. 5 is a side view of a modified base part for a dynamically sealed processing chamber, partly in section on section line V—V of FIG. 6.
Figure 6:
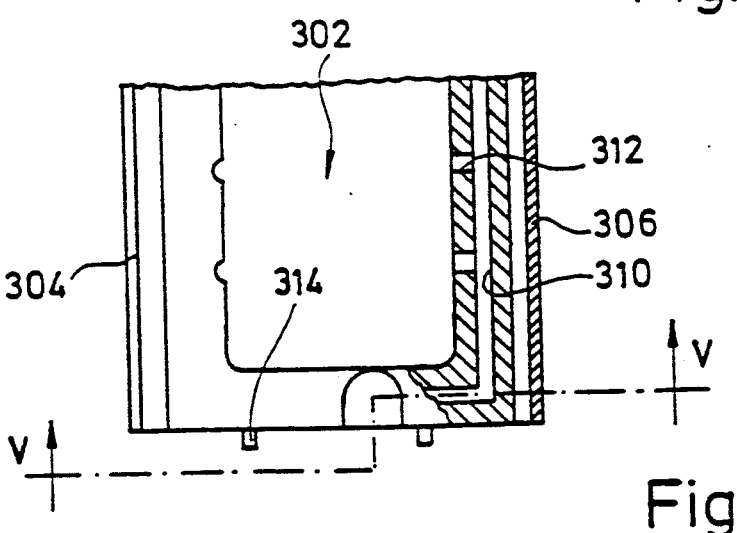
FIG. 6 is a plan view of one end of the base part shown in FIG. 5, partly in section along the section line VI—VI of FIG. 5.

FIGS. 5 and 6 show a modified base part 302 with elastically deformable sealing lips 304, 306 injection-moulded on the front and rear end, which are shown by full lines in the unloaded state and by broken lines in the installed state. Lower rollers of pairs of rollers, which co-operate with the sealing lips 304, 306, are likewise shown in broken line in FIG. 5.

The base part 302 has a single supply opening 308, which is connected to a U-shaped distribution channel 310 seen in plan view. The latter discharges the processing liquid by way of a plurality of openings 312. The end walls of the base part 302 support bayonet pins 314, which co-operate with corresponding bayonet grooves in the side plates 56, 58.

The movement to be carried out for inserting the base part 302 in the side plates 56, 58 is indicated by a vertical arrow 316 in FIG. 5 and an adjoining horizontal arrow 318. As can be seen from FIG. 5, the horizontal arrow 318 is so long that when carrying out the movement defined by the vertical arrow 316, the sealing lips 304, 306 do not abut against the rollers co-operating with the sealing lips at a later stage. Only when carrying out the second movement represented by the horizontal arrow 318 do the sealing lips 304, 306 come into abutment with the associated rollers, in which case they are subjected to elastic bending stress.

Due to the above-described positive guidance for the fitting of the bottom parts on the side plates, kinking of the sealing lips and thus an unsatisfactory sealing position between the sealing lips and rollers co-operating therewith is precluded.

Figure 7:
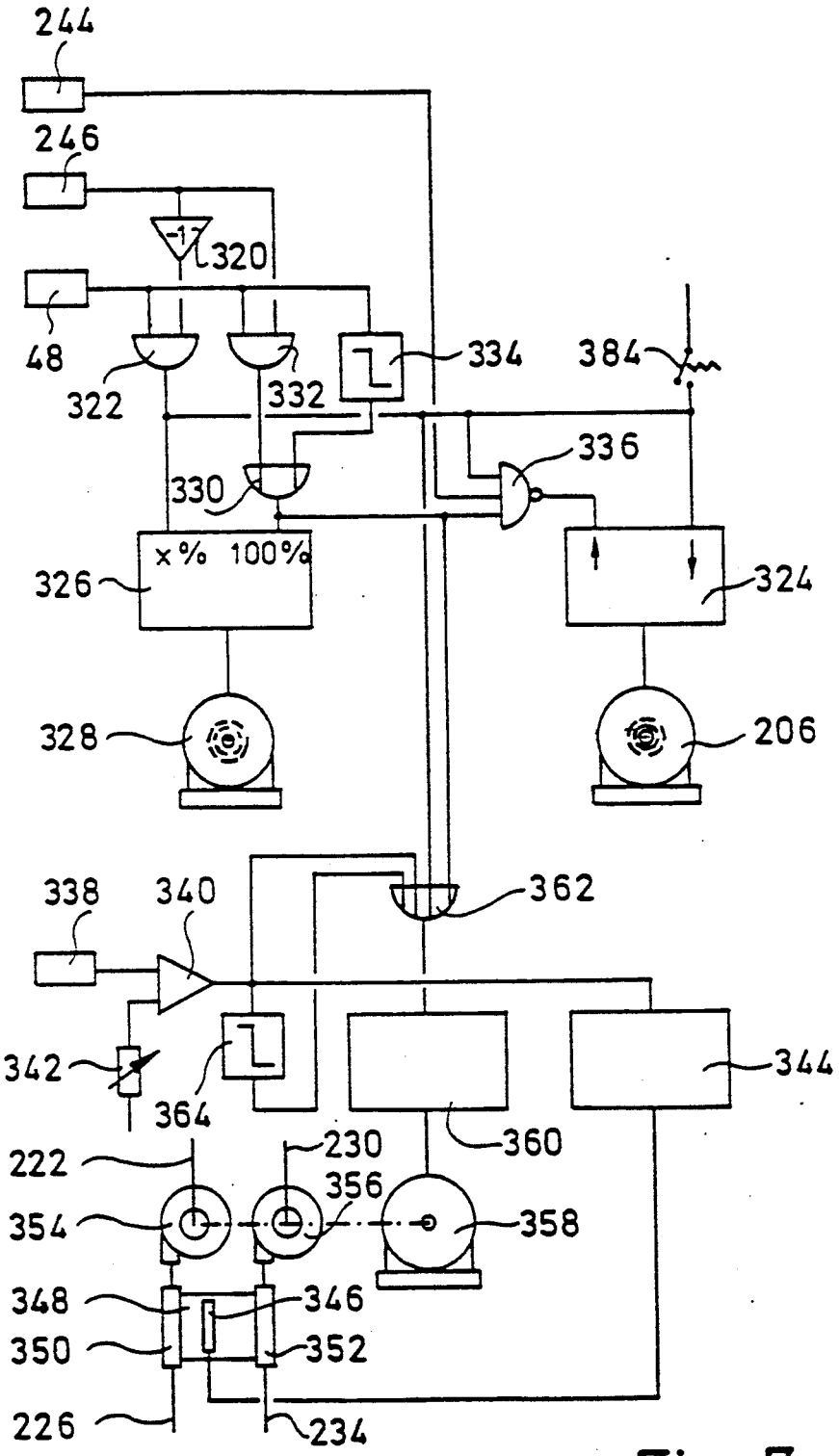
FIG. 7 is a block circuit diagram for the control of the main drive motor for the conveying rollers of the developing apparatus, of the motor of the lifting device for the flood troughs in the developer and fixer region and of the motor for the pumps for circulating developer and fixing liquid.

Reference will now be made to FIG. 7.

The output of the light barrier 246 representing a lower end position sensor for the flood tanks is connected by way of an inverter 320 to a first input of an AND-gate 322. At its second input, the latter receives the output signal from the light barrier 48, which responds to the presence of film material to be developed in front of the feed opening of the device. One thus obtains a signal at the output of the AND-gate 322 when film material is to be developed, but the two flood tanks are not in their lower end position, thus still block the conveying path.

The output signal of the AND-gate 322 is sent to the step-down control terminal of a control circuit 324 for the synchronous motor 206. When this signal occurs, the control circuit 324 sets the synchronous motor 206 in movement in such a direction of rotation that the crank disc 184 rotates in counter-clockwise direction. This movement is terminated when the lower end position sensor formed by the light barrier 246 produces an output signal.

The output signal of the AND-gate 322 is also sent to a slow control terminal of a control circuit 326 for a drive motor 328 of the conveying device, which by way of power transmissions (gear trains, toothed belts or the like) not shown in the drawings, drives the various rollers of the various racks of the developing device in synchronism. When the slow control terminal receives a signal, the control circuit 326 causes the drive motor 328 to rotate at such a speed that the rollers are driven just so fast that the front edge of the piece of film introduced for developing travels just beyond the intermediate wall 16, when the upper edge of the front wall of the developer flood tank 144 has cleared the access to the inlet opening of the developer rack 60 defined by the pair of rollers 64. The corresponding fraction of the full operating speed of the drive motor 328 is indicated by "x%" at the control terminal of the control circuit 326.

The second "100%"-control terminal of the control circuit 326 bringing about the full working speed of the drive motor 328 then receives a signal, when material to be developed is located behind the intermediate wall 16 in the developing device. For this purpose, this control terminal is preceded by an OR-gate 330. One input thereof is connected to the output of an AND-gate 332, whereof the inputs receive the output signal from the light barrier 246 and the output signal from the light barrier 48. Thus, the full operating speed of the drive motor 328 is always pre-set when the double flood tank 142 is fully lowered and film material still to be developed is located opposite the light barrier 48.

Also connected to the output of the light barrier 48 is a monostable flip-flop unit 334 which is triggered at trailing edges, whereof the output is connected to the second input of the OR-gate 330. The period of the monostable flip-flop unit 334 is chosen to be somewhat greater than the time interval which the rear edge of the piece of film leaving the light barrier 48 requires for passing completely through the developing apparatus.

The step-up control terminal of the control circuits 324 is preceded by a NAND-gate 336, whereof the inputs are connected to the output of the AND-gate 322, the light barrier 244 and the OR-gate 330. The double flood tank 142 is thus only raised when material to be developed is no longer located in the entire developing apparatus and also no new piece of film is introduced into the developing apparatus.

In the lower part of FIG. 7, the reference numeral 338 represents a temperature sensor for the temperature of the developing liquid, which can be located in the developer tank 60 or at another point of the circuit of the developing liquid. The temperature sensor 338 is connected to one input of a comparator 340, whereof the second input is connected to a reference temperature transmitter shown as an adjustable resistor 342. If the temperature measured is below the reference temperature, then the comparator 340 controls a control circuit 344, by which a heating resistor 346 is supplied with power. The heating resistor 346 is seated on a heat-conducting plate 348, welded to the ends of which are two pipe sections 350, 352. The latter are connected to the outlet openings of two circulating pumps 354, 356, which by way of the return hoses 222, 230 suck developing liquid or fixing liquid from the corresponding tank chambers of the housing 10 and force it into the supply hoses 226 and 234.

The circulating pumps 354 and 356 are driven by a common pump motor 358, for which a control circuit 360 is provided.

The input terminal of the control circuit 360 is connected to the output of an OR-gate 362, whereof the inputs are connected to the output of the OR-gate 330, the output of the AND-gate 322, the output of the comparator 340 and the output of a monostable flip-flop unit 364. After reaching the reference temperature at the temperature sensor 338, the monostable flip-flop unit 364 ensures that the pump motor 358 continues to operate for such a long time that the heat stored in the heating device formed by the components 348 to 352 is reliably transmitted to the processing liquids, so that no overheating of the portions of liquid in this heating device takes place.

In a practical embodiment of the above-described continuous developing apparatus, which can be used in dental practices or other medical practices with a small number of X-ray films to be developed, without renewing the chemicals for approximately four weeks, in total five liters of developing liquid and five liters of fixing liquid are used. Due to the removal of liquid by the material to be developed and due to the evaporation of water, the volume of liquid is reduced typically by 1.5 liters in each case, in four weeks. Since dynamically sealed processing chambers are used in the developing region and fixing region, this loss of liquid at the most has a secondary effect on the operating conditions in the dynamically sealed processing chambers: when the developing apparatus is operating, the level of the liquid in the developing tank chamber 30 or in the fixing tank chamber 34 is increasingly deeper.

If, after approximately four weeks, it is necessary to change the processing liquids completely, then by way of valves which are not shown in detail, the return hoses 222 and 230 are connected to the drainage channel and the processing liquids remaining in the tank chambers flow out in that direction. Subsequently, the developing rack 60 and the fixing rack 62 are lifted upwards jointly (with the apparatus switched off, thus with the double flood tank 142 raised). With the exchange of the racks, the liquid level in the flood tanks 144 and 146 drops considerably, so that when dismantling and lifting out the flood tanks, even relatively great accidental tilting does not lead to splashing-over of processing liquid. The double flood tank 142, which then typically still contains three-quarters of a liter of the corresponding processing liquid, can be carried to a drain and emptied there and cleaned with running water.

After the reinstallation of the double flood tank 142 and of the developing rack 60 as well as of the fixing rack 62, the return hoses 222 and 230 are once more separated from the discharge channel by reversing the corresponding valves and one can then pour a supply of five liters of developing liquid and fixing liquid, which is sufficient for operation for a further four weeks, simply from above into the developing unit or fixing unit. The major part of the processing liquids which cannot be held back by the flood tanks 144 and 146 then flows by way of the overflow recesses 252, 254 into the tank chambers located therebelow. After this change of chemicals, the rollers of the developing unit and of the fixing unit are protected against the formulation of salt crusts, even without switching on the developing apparatus.

Figure 9:
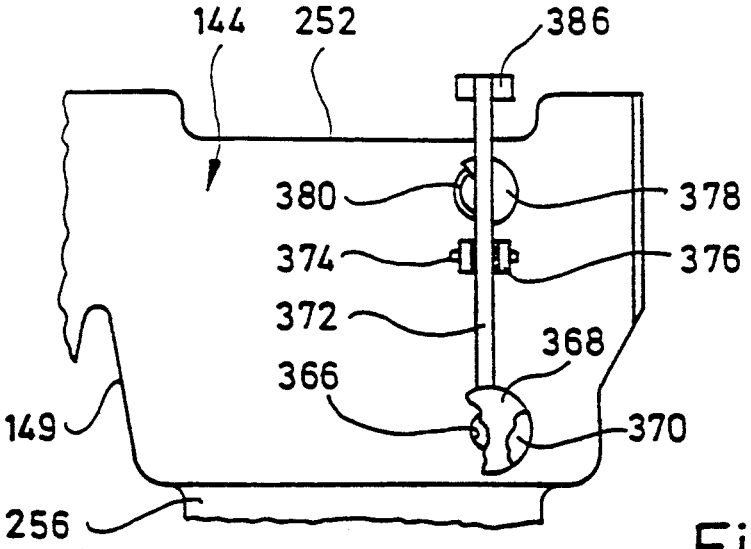
FIG. 9 is a vertical longitudinal section through a further modified double flood tank.
Figure 10:
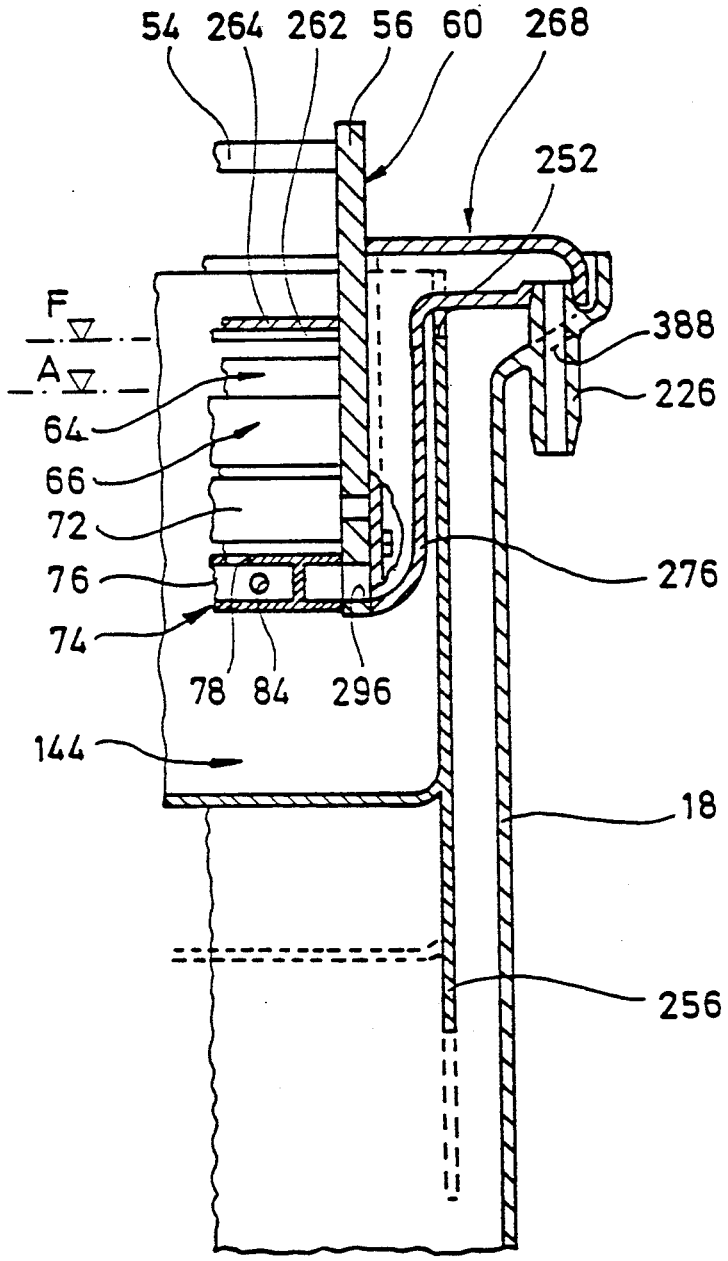
FIG. 10 is a section through a modified supply part for processing liquid and of the adjacent sections of the dynamically sealed processing chamber, of the associated flood tank and of the adjacent region of the tank housing.

For areas of use where frequent basic cleaning of the flood tanks is not necessary, the flood tanks can be provided with drainage valves, in order that the contents of the flood tanks together with the contents of the tank chambers located therebelow can be discharged for the complete exchange of the processing liquid. FIGS. 9 and 10 show two appropriately modified developing flood tanks 144. Drainage valves constructed in a similar manner are provided on the fixing flood tank 146 not shown in FIGS. 8 and 9.

Figure 8:
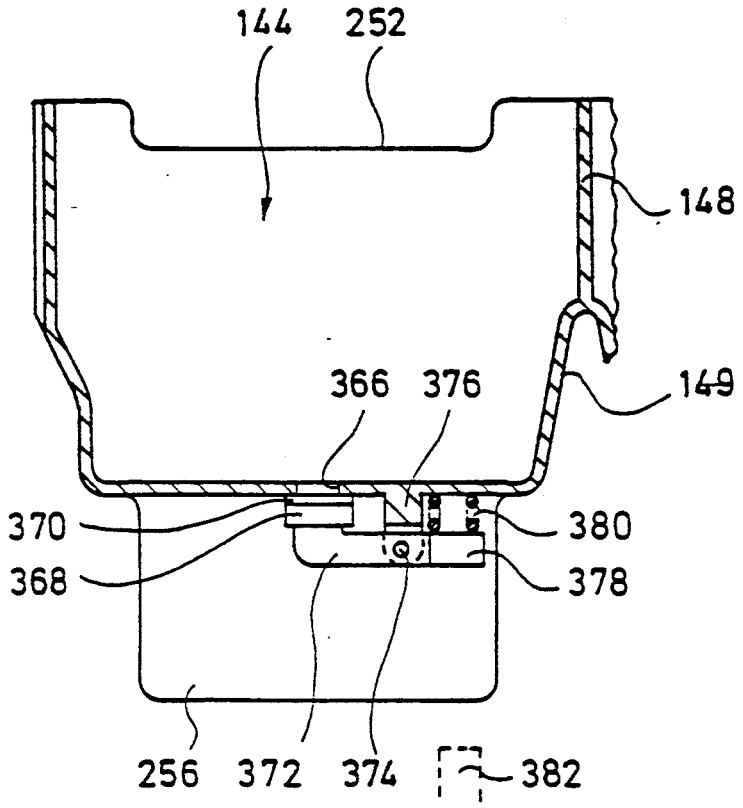
FIG. 8 is a vertical longitudinal section through a modified double flood tank.

In the developing flood tank 144 illustrated in FIG. 8, the base is constructed to slope slightly towards the centre, and provided at this deepest point of the base is a drainage opening 366. The latter is covered by a valve body 368, which supports a resilient sealing disc 370.

The valve body 368 is sealed at the free end of a rocker arm 372, which is mounted by way of a swivel pin 374 in a bearing lug 376 formed on the base of the flood tank 144.

The second end of the rocker arm 372 is constructed with a spring seat plate 378. Inserted between the upper side of the spring seat plate 378 and the under side of the base of the flood tank 144 is a helical compression spring 380. The latter keeps the valve body 368 in the position closing off the drainage openings 366.

Aligning vertically with the spring seat plate 378, the housing 10 supports a stop 382, which is shown in broken line in FIG. 8. This stop is arranged so that it is reached by the spring seat plate 378 either shortly before reaching the operating position of the flood tank 144 or solely after the movement beyond this operating position.

In the former case, the valve body 368 is opened positively each time the flood tank 144 is lowered, so that in the operating position, the flood tank 144 acts as a funnel. The overflow recess 252 then becomes active solely in the raised flooding position of the flood tank 144. With this choice of the position of the stop 382, the pump motor 358 must also be allowed to operate during the lifting of the flood tanks, in order that the flood tanks now containing only a little liquid in the operating position, fill up with processing liquid.

On the other hand, if the stop 382 is located so low that it is not yet reached in the lower operating position of the flood tanks clearing the conveying path, one must choose the working stroke of the lifting device to be somewhat greater than the vertical distance between the flooding position and operating position of the flood tanks 144, 146. The light barrier responding to reaching the operative position and the mirror 250 co-operating therewith remain arranged so that the synchronous motor 206 is switched off on reaching the operating position. However, in this position, the crank pins 180 and 182 have not yet reached their bottom dead centre. By supplying signals to the step-down control terminal of the control circuit 324, using a hand-actuated switch 384, when the processing liquids are completely exchanged, one can move the spring seat plate 378 against the stop 382 and thus lift the valve body 368 from the drain opening 366. The contents of the flood tanks 144, 146 then flow into the tank chamber located therebelow and from there into the discharge channel.

In the modified embodiment according to FIG. 9, the drainage opening 366 is provided at the lower end of the left-hand side wall of the developing flood tank 144. In a corresponding manner, the bearing lug 376, the rocker arm 372, the helical compression spring 380 and the spring seat plate 378 are also located in front of this side wall. The end located at the top in FIG. 10 is provided with an actuating plate 386, which is easily accessible from above. Due to manual actuation of the rocker arm 372, the contents of the flood tank 144 can be let out as required, in particular for the complete exchange of the processing liquids.

FIG. 10 is a vertical section through a modified developing unit along its transverse central plane. In the supply part 268, the external inlet section 272 leading downwards is omitted, an inlet opening is provided directly in the lower wall of the projecting section. This inlet opening is constructed with a conical wall and is seated directly on an end of the developing supply connection 224 constructed appropriately in a conical manner. The latter is seated in an obliquely sloping shoulder 388 of the left-hand side wall 18 adjacent the overflow recess 252.

In FIG. 10, the flood level determined by the overflow recess 252 is marked by the reference F and the operating level adjusted by the overflow opening 102 when the apparatus is operating, is designated by the reference A.

Figure 11:
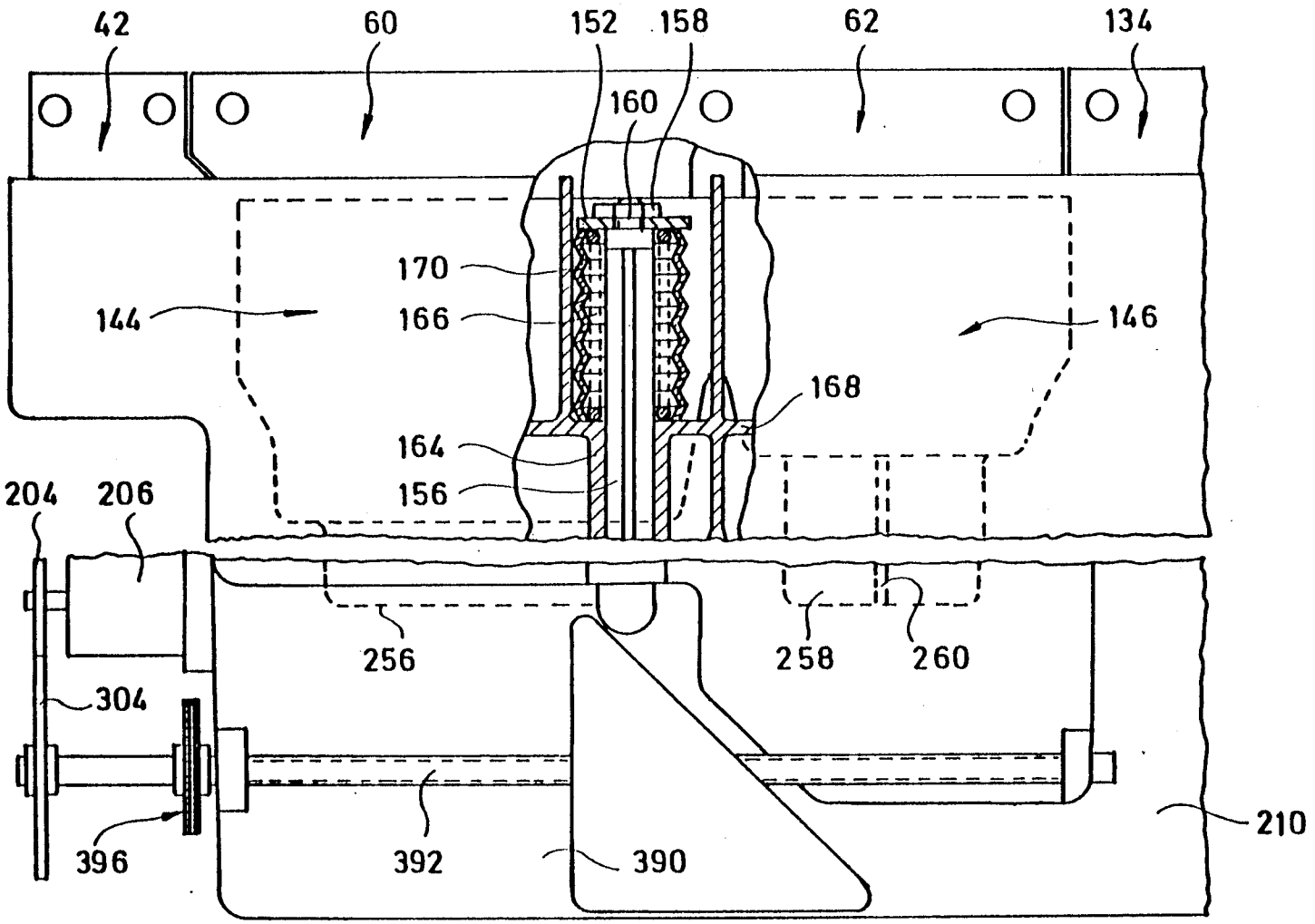
FIG. 11 is a similar view to that of FIG. 2, in which a modified lifting device is illustrated.

In the modified lifting device illustrated in FIG. 11, the spherical lower ends of the lifting rods 154, 156 travel on wedge members 390. In their lower section, the latter have a thread, which travels respectively on a threaded spindle 392. The threaded spindle 392 is driven by way of a gear 394 and the pinon 204 is driven by the synchronous motor 206. A chain drive 396 serves for the coupling of both threaded spindles. In this embodiment, the helical springs 166 must be chosen to be so weak that the flood tanks drop themselves under their own weight and the weight of the volumes of liquid contained therein. In this embodiment, if one desires positive lowering of the flood tanks, the wedge surface of the wedge member 390 must be replaced by a correspondingly inclined cam groove of a cam plate travelling on the threaded spindle 392, in which a cam pin replacing the connecting pin 172 travels.

Figure 12:
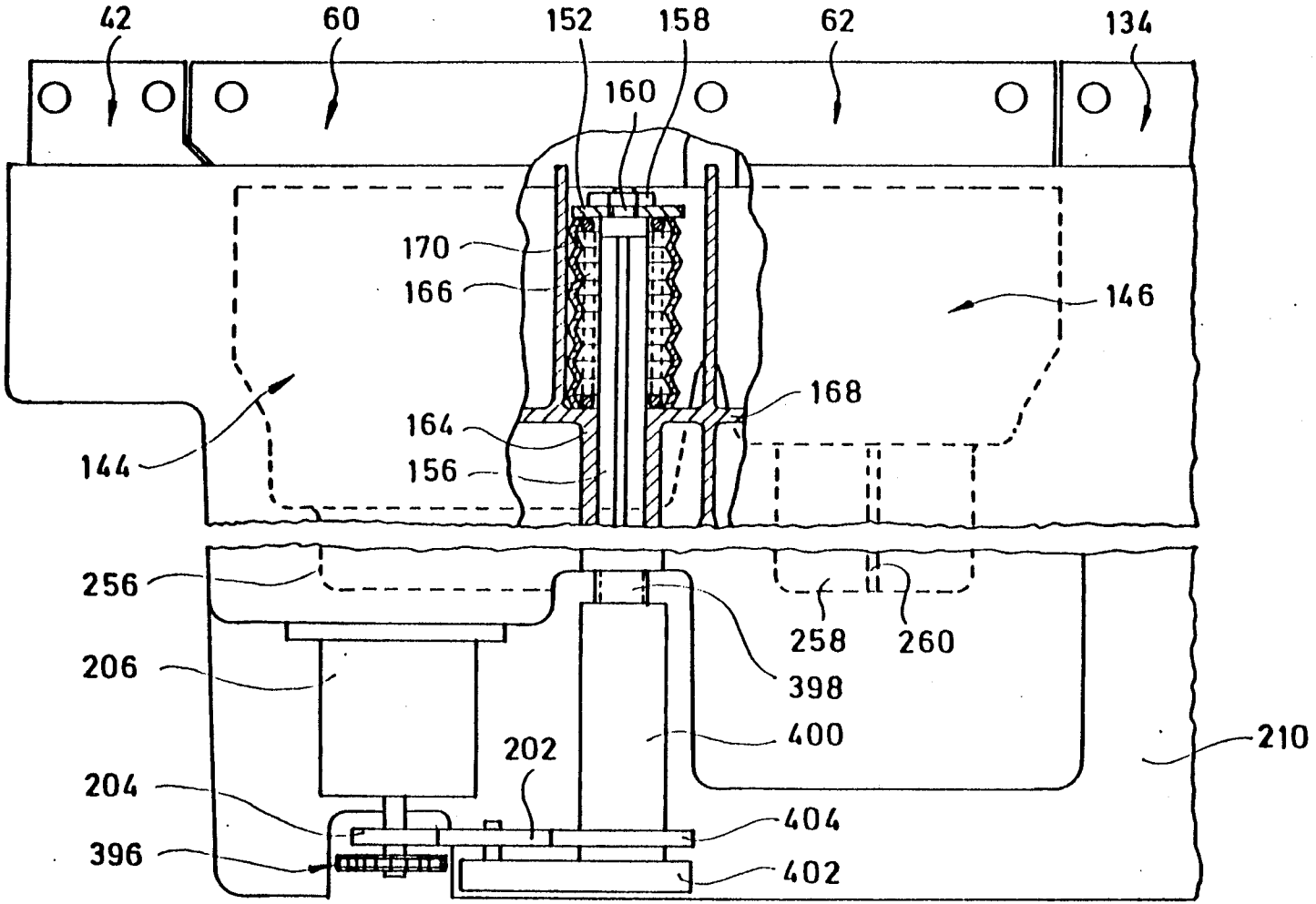
FIG. 12 is a similar view to FIG. 2, in which a further modified lifting device is illustrated.

In a further modified embodiment according to FIG. 12, the lower end of the lifting rods 154, 156 is constructed as a threaded spindle 398. The latter co-operates with an axially stationary, rotary threaded sleeve 400, which is mounted in a bearing block 402 of the housing 10 and supports a toothed rim 404, which meshes with a freewheeling gear 202, which is driven by the pinion 204 of the synchronous motor 206. The chain drive 396 against serves for the coupling of the two threaded sleeves 400.

In a further modification of the invention, the vertical displacement of the double flood tank 142 can also be brought about directly by two hydraulic cylinders, whereof the working chambers are connected in series and which are synchronized hydraulically. Also, lever bars, for example parallelogram linkages are suitable for the parallel raising and lowering of the double flood tank.

In the embodiments according to FIGS. 11 and 12, the light barriers 244 and 246 are replaced by end position sensors co-operating directly with the flood tanks, for example inductive proximity switches.

We claim:

1. Continuous developing apparatus for photographic films, in particular X-ray films, with at least one processing chamber for receiving a processing liquid, in which a working level of the processing liquid lying above the conveying plane of the material to be developed can be maintained, for which purpose a dynamic sealing arrangement is respectively provided at an inlet opening and an outlet opening of the processing chamber, through which arrangement the material to be developed may pass and in which conveying means for moving the material to be developed are disposed, with outer tanks surrounding the processing chambers, into which processing liquids leaking from the dynamically sealed processing chambers fall and with circulating pumps associated with the processing chambers, which each suck a processing liquid from the associated outer tank and convey it into the associated, dynamically sealed processing chamber, characterised in that disposed between the outer tank (30, 34) and the dynamically sealed processing chambers (100, 130) is a flood tank (144, 146) respectively, which can be moved by a lifting device (150 to 206) between a raised flooding position, in which the liquid level contained therein and the associated processing chamber (30, 34) lies above the conveying means (64 to 72, 104 to 108) and the dynamic sealing arrangements (64, 70, 86, 88; 104, 108, 122, 124) and a lowered operating position, in which the inlet opening and the outlet opening of the processing chambers (100, 130) is free.

2. Apparatus according to claim 1, characterised in that the flood tanks (144, 146) are provided with an overflow recess (252, 254) at the upper edge of at least one of their boundary walls.

3. Apparatus according to claim 2, characterised in that at the boundary walls provided with overflow recesses (252, 254), the flood tanks (144, 146) are provided with drip bars (256, 258) projecting downwards beyond the base of the flood tanks.

4. Apparatus according to claim 3, characterised in that even at the lowest, still admissible liquid level in the outer tank (30, 34) the drip bars (256, 258) are still immersed in the volume of liquid located therein.

5. Apparatus according to claim 3, characterised in that the overflow recesses (252, 254) are provided on lateral boundary walls of the flood tanks (144, 146) extending parallel to the conveying direction of the material to be developed.

6. Apparatus according to claim 5, characterised in that the overflow recesses (252, 254) are provided on the lateral boundary wall of the flood tanks (144, 146) remote from a driving device for the conveying means (64 to 70, 90; 104 to 108).

7. Apparatus according to claim 6, characterised in that extending downwards from the base of a flood tank (144, 146) is a support (260) spaced-apart from the drip bar (256, 258), which support has the same height as the drip bar.

8. Apparatus according to claim 1, characterised in that at least two flood tanks (144, 146) following each other in the conveying direction are securely connected to each other.

9. Apparatus according to claim 8, characterised in that the base of the multiple flood tank (144) comprises at least one recess (149), into which an intermediate wall (26) located below the multiple flood tank arrangement (142) and which separates the associated outer tanks (30, 34) can be introduced at the time of lowering the flood tank arrangement.

10. Apparatus according to claim 1, characterised by a spring arrangement (166) biasing the flood tanks (144, 146) vertically upwards, the strength of which spring arrangement is chosen with regard to the weight of the flood tanks (144, 146) filled with processing liquids.

11. Apparatus according to claim 1, characterised by two lifting rods (154, 156) arranged at the lateral boundary walls of the flood tanks (144, 146) and by means (188; 398) for the positive coupling of the movement of both lifting rods (154, 156).

12. Apparatus according to claim 11 in conjunction with claim 10, characterised in that the spring arrangement comprises helical springs (166) surrounding the lifting rods (154, 156).

13. Apparatus according to claim 11, characterised in that the upper ends of the lifting rods (154, 156) and preferably also the helical springs (166) surrounding them are sealed by bellows (170).

14. Apparatus according to claim 11, characterised in that the flood tanks (144, 146) are located at the upper ends of the lifting rods (154, 156) by way of quick release connections (158, 160).

15. Apparatus according to claim 1, characterised in that a base part (74; 110; 302) of the processing chambers (100; 130) is respectively constructed as a distribution part for processing liquid and a side wall of the processing chamber respectively supports an upwardly extending supply part (268, 270), which with a projecting upper supply part section engages over the upper edge of the associated flood tank (144, 146) in the raised tank position.

16. Apparatus according to claim 15, in conjunction with claim 2, characterised in that the supply part (268, 270) is located in the region of the overflow recess (252, 254) and engages over its lower edge.

17. Apparatus according to claim 15, characterised in that the supply part (268, 270) comprises a supply opening pointing downwards, which when the processing chamber (100; 130) is introduced, lies close above a delivery opening (224, 232) integral with the housing, for the processing liquid in question.

18. Apparatus according to claim 17, characterised in that the delivery opening (224, 232) integral with the housing lies substantially at the same height as the edge of the associated flood tank (144, 146), beyond which the supply part (268, 270) engages.

19. Apparatus according to claim 17, characterised in that the delivery opening (224, 232) integral with the housing is surrounded by a shoulder (388) sloping obliquely inwards, of a side wall (18) of the outer tank (30; 34).

20. Apparatus according to claim 15, characterised in that the base part (74; 110; 302) comprises a plurality of outlet openings (78; 114; 312) for the associated processing liquid.

21. Apparatus according to claim 15, characterised in that the front and rear end of the base part (74; 110; 302) seen in the conveying direction, supports resilient sealing lips (86, 88; 122, 124; 304, 306), which co-operate respectively with the lower roller (90, 92; 126, 128) of a pair of rollers (64, 70; 104, 108), which ensures the dynamic seal of the inlet opening or outlet opening of the processing chamber (100; 130) in question.

22. Apparatus according to claim 21, characterised by co-operating guide means (298, 300) provided on the base part (74; 110; 302) and on the side walls (56, 58) of the processing chamber (100; 130), which guarantee that in the first part of the mounting movement of the base part, the sealing lips (86, 88; 122, 124; 304, 306) do not encounter the lower rollers (90, 92; 126; 128) co-operating therewith and that the last section of the mounting movement of the base part on the side walls takes place so that the free ends of the sealing lips are guided substantially radially towards the lower rollers co-operating therewith.

23. Apparatus according to claim 22, characterised n that the guide means comprise bayonet grooves (298) and bayonet pins (300).

24. Apparatus according to claim 21, characterised in that the base part (74; 110; 302) is a synthetic injection-moulded part and the sealing lips (86, 88; 122, 124; 304, 306) consist of resilient synthetic material and are injection-moulded directly on the base part.

25. Apparatus according to claim 1, characterised in that the lifting device comprises crank pins (180, 182), which act by way of connecting rods (176, 178) on the flood tanks (144, 146).

26. Apparatus according to claim 25 in conjunction with claim 11, characterised in that the two lifting rods (154, 156) are each connected by way of a connecting rod (176, 178) to an associated crank pin (180, 182) and both crank pins are connected by a shaft (188).

27. Apparatus according to claim 1, characterised in that the lifting device comprises a wedge arrangement (390) acting on the flood tanks (144, 146).

28. Apparatus according to claim 1, characterised in that the lifting device comprises a threaded drive (400, 402) acting on the flood tanks (144, 146).

29. Apparatus according to claim 1, characterised by end position sensors (244 to 250) for the raised flooding position and the lowered operating position of the flood tanks (144, 146) as well as an inlet sensor (48), which responds to the presence of material to be developed at the inlet opening of the apparatus, as well as a lifting motor control circuit (324) for a drive motor (206) of the lifting device, which energizes this motor by a first control signal in the direction for raising the flood tanks (144, 146), when an output signal of the inlet sensor (48), but no output signal of the end position sensor (246) for the lowered operating position is available, whereas it energizes the drive motor (206) by a second control signal in the direction for lowering the flood tanks (144, 146), when a given time interval has elapsed from the time when the output signal of the inlet sensor (48) has died away.

30. Apparatus according to claim 29, characterised by a conveying motor control circuit (322, 330 to 334) for a second drive motor (328) acting on the conveying means (64 to 70, 104 to 108), which controls the second drive motor by a first control signal for operating at a first speed when it receives the first control signal and for operating at a second speed when it receives the second control signal, the first speed being chosen so that the front edge of the material to be developed reaches the inlet opening of the first processing chamber (100) provided with a flood tank (144), when this flood tank (144) has just freed the inlet opening of the processing chamber and the second speed is chosen with regard to the desired processing time of the material to be developed in the various processing chambers (100; 130).

31. Apparatus according to claim 29, characterised by a pump motor control circuit (322, 330 to 334, 362) for a drive motor (358) of a circulating pump arrangement (354, 356), which energizes this drive motor (358) when it receives the first control signal, the second control signal or the output signal of a temperature switch (338 to 342).

32. Apparatus according to claim 31, characterised by a timing member (364) able to be triggered by the trailing edge of the output signal of the temperature switch (338 to 342), the output signal of which timing member likewise causes the pump motor control circuit (322, 330 to 334, 362) to energize the pump drive motor (358).

33. Apparatus according to claim 1, characterised in that in their lower section, the flood tanks (144, 146) are provided with a delivery opening (366), which is normally closed by a valve body (368) biased into the closing position and can be opened by moving an actuating part (378, 386).

34. Apparatus according to claim 33, characterised in that the actuating part (378) can be actuated by the vertical movement of the flood tanks (144, 146) against a stop (382) integral with the housing.

* * * * *